US009153092B2

(12) United States Patent
Lachance et al.

(10) Patent No.: US 9,153,092 B2
(45) Date of Patent: Oct. 6, 2015

(54) PRIZE MERCHANDISER

(71) Applicant: ADRENALINE AMUSEMENTS INC., Terrebonne, Quebec (CA)

(72) Inventors: David Lachance, Terrebonne (CA); Stephanie Pichette, Terrebonne (CA)

(73) Assignee: Adrenaline Amusements Inc., Québec (CA)

( * ) Notice: Subject to any disclaimer, the term of this patent is extended or adjusted under 35 U.S.C. 154(b) by 552 days.

(21) Appl. No.: 13/650,357

(22) Filed: Oct. 12, 2012

(65) Prior Publication Data

US 2014/0106855 A1 Apr. 17, 2014

(51) Int. Cl.

| | |
|---|---|
| ***A63F 9/30*** | (2006.01) |
| ***G07F 11/24*** | (2006.01) |
| ***G07F 11/36*** | (2006.01) |
| ***G07F 11/38*** | (2006.01) |
| ***G07F 11/50*** | (2006.01) |
| ***G07F 11/52*** | (2006.01) |
| ***G07F 17/32*** | (2006.01) |

(52) U.S. Cl.

CPC ..... *G07F 17/3209* (2013.01); *G07F 17/3204* (2013.01); *G07F 17/3211* (2013.01); *G07F 17/3216* (2013.01); *G07F 17/3246* (2013.01); *G07F 17/3253* (2013.01); *G07F 17/3262* (2013.01); *G07F 11/24* (2013.01); *G07F 11/36* (2013.01); *G07F 11/38* (2013.01); *G07F 11/50* (2013.01); *G07F 11/52* (2013.01); *G07F 17/3297* (2013.01)

(58) Field of Classification Search

CPC ..... G07F 11/24; G07F 11/36; G07F 11/38; G07F 11/50; G07F 11/52; G07F 17/3253; G07F 17/3297; G07F 17/3204; G07F 17/3226; G07F 17/3209; G07F 17/3211; G07F 17/3246; G07F 17/3262

USPC ..... 463/7, 25; 273/441, 459, 460, 454

See application file for complete search history.

(56) References Cited

U.S. PATENT DOCUMENTS

| | | | | | |
|---|---|---|---|---|---|
| 4,976,440 | A | | 12/1990 | Faith | |
| 5,236,103 | A | * | 8/1993 | Ficken et al. | 221/124 |
| 5,911,419 | A | * | 6/1999 | Delaney et al. | 273/292 |
| 5,967,892 | A | * | 10/1999 | Shoemaker, Jr. | 463/7 |
| 6,080,061 | A | * | 6/2000 | Watanabe et al. | 463/16 |
| 6,139,429 | A | * | 10/2000 | Shoemaker, Jr. | 463/7 |

(Continued)

FOREIGN PATENT DOCUMENTS

| | | |
|---|---|---|
| JP | 2003162759 | 6/2003 |
| WO | WO 2006/000050 A1 | 1/2006 |

*Primary Examiner* — William H McCulloch, Jr.

(74) *Attorney, Agent, or Firm* — Muirhead and Saturnelli, LLC

(57) ABSTRACT

The invention relates to a prize merchandiser comprising a cabinet, a see-through monitor extending through a front wall of the cabinet, a touch screen overlay mounted over the see-through monitor, a coin acceptor attached to the cabinet, a prize dispenser mounted inside the cabinet, and a computer unit connected to the coin acceptor, the prize dispenser, the see-through monitor and the touch screen overlay. The prize dispenser has a prize storage area extending behind the see-through monitor so that prizes in the prize storage area are visible through the see-through monitor during game play and when nobody plays a game. The computer unit is configured to run an interactive video game that displays on the see-through monitor and is controlled by player interactions with the touch screen overlay, and to operate the prize dispenser so as to dispense a prize based on an outcome of the video game.

16 Claims, 8 Drawing Sheets

(56) References Cited

U.S. PATENT DOCUMENTS

| | | | | |
|---|---|---|---|---|
| 6,315,157 | B1 | 11/2001 | Halliburton | |
| 6,550,774 | B1 * | 4/2003 | Stroll et al. | 273/447 |
| 6,695,698 | B1 * | 2/2004 | Anghelo et al. | 463/25 |
| 6,705,486 | B1 | 3/2004 | Noell | |
| 6,860,814 | B2 * | 3/2005 | Cole | 463/46 |
| 7,458,890 | B2 * | 12/2008 | Loose et al. | 463/16 |
| 7,479,065 | B1 * | 1/2009 | McAllister et al. | 463/37 |
| 7,513,505 | B2 * | 4/2009 | Berman et al. | 273/447 |
| 7,597,214 | B2 * | 10/2009 | Levasseur | 221/124 |
| 7,654,534 | B2 * | 2/2010 | Matsuda | 273/448 |
| 7,793,938 | B2 * | 9/2010 | Watanabe | 273/447 |
| 7,841,599 | B2 * | 11/2010 | Todokoro | 273/447 |
| 7,900,929 | B2 * | 3/2011 | Takasugi | 273/447 |
| 7,918,458 | B2 * | 4/2011 | Fukazawa et al. | 273/448 |
| 8,234,207 | B2 * | 7/2012 | Breitenbach et al. | 705/37 |
| 8,251,370 | B2 * | 8/2012 | Guarnieri et al. | 273/448 |
| 8,323,093 | B2 * | 12/2012 | McAllister et al. | 463/20 |
| 8,353,518 | B1 * | 1/2013 | Lai et al. | 273/447 |
| 8,357,033 | B2 * | 1/2013 | Williams et al. | 463/20 |
| 8,579,733 | B2 * | 11/2013 | McGrath | 473/448 |
| 8,666,874 | B2 * | 3/2014 | Breitenbach et al. | 705/37 |
| 8,882,111 | B2 * | 11/2014 | Shoemaker, Jr. | 273/447 |
| 2002/0088819 | A1 * | 7/2002 | Wei | 221/210 |
| 2003/0054888 | A1 | 3/2003 | Walker et al. | |
| 2004/0018865 | A1 * | 1/2004 | Gilmore et al. | 463/7 |
| 2004/0133705 | A1 * | 7/2004 | Broussard et al. | 710/1 |
| 2004/0162633 | A1 * | 8/2004 | Kraft et al. | 700/234 |
| 2005/0101388 | A1 * | 5/2005 | Hattori | 463/46 |
| 2005/0255924 | A1 * | 11/2005 | Cole | 463/46 |
| 2006/0106488 | A1 | 5/2006 | Zito, Jr. | |
| 2007/0235468 | A1 * | 10/2007 | Liva | 221/129 |
| 2008/0020839 | A1 * | 1/2008 | Wells et al. | 463/31 |
| 2008/0182643 | A1 * | 7/2008 | Seelig et al. | 463/20 |
| 2009/0039101 | A1 * | 2/2009 | Alcov | 221/155 |
| 2009/0191931 | A1 * | 7/2009 | Peck | 463/7 |
| 2011/0183741 | A1 * | 7/2011 | Smart | 463/17 |
| 2012/0094732 | A1 * | 4/2012 | Cole | 463/13 |
| 2012/0220361 | A1 * | 8/2012 | Plescia | 463/25 |
| 2012/0228828 | A1 * | 9/2012 | Riggles | 273/447 |
| 2013/0130774 | A1 * | 5/2013 | Williams et al. | 463/20 |
| 2013/0221018 | A1 * | 8/2013 | Garson | 221/1 |
| 2013/0292907 | A1 * | 11/2013 | Jeong et al. | 273/447 |
| 2013/0300058 | A1 * | 11/2013 | Stellenberg | 273/121 A |
| 2014/0018150 | A1 * | 1/2014 | Wells et al. | 463/20 |
| 2014/0076921 | A1 * | 3/2014 | Chen et al. | 221/277 |
| 2014/0106855 | A1 * | 4/2014 | Lachance et al. | 463/25 |
| 2014/0195041 | A1 * | 7/2014 | Hoormann | 700/232 |

* cited by examiner

PRIZE MERCHANDISER

FIELD OF THE INVENTION

The present invention relates to a gaming device and more particularly to a prize merchandiser with a see-through monitor acting both as a window to promote prizes and a screen for game play.

BACKGROUND

Various gaming devices can be found in arcades, casinos and other public places or not, such as slot machines, video pokers, pachinkos, merchandisers. In the merchandiser category, claw cranes containing plush toys to pick up for winning are among the most popular ones. In the other categories, the prizes are often money or equivalent coupons redeemable for products or services. Examples of gaming devices known in the art are shown in US20030054888 (Walker et al.), US20060106488 (Zito, Jr.), US20080182643 (Seelig et al.), US20090191931 (Peck), US20110183741 (Smart), U.S. Pat. No. 4,976,440 (Faith), U.S. Pat. No. 6,139,429 (Shoemaker, Jr.), U.S. Pat. No. 6,315,157 (Halliburton), U.S. Pat. No. 6,550,774 (Stroll et al.), U.S. Pat. No. 6,695,698 (Anghelo et al.), U.S. Pat. No. 6,705,486 (Noell), WO2006000050 (Muir) and JP2003162759 (Kaneshiro). There is always a need for the gaming industry to come up with new and original gaming devices likely to attract players.

SUMMARY

An object of the invention is to provide a gaming device that meets the aforesaid need of the gaming industry.

Another object of the invention is to provide a gaming device in the form of a prize merchandiser with a see-through monitor acting both as a window to promote prizes and a screen for game play.

According to one aspect of the invention, there is provided a prize merchandiser comprising:

- a cabinet having a front wall;
- a see-through monitor extending through the front wall;
- a touch screen overlay mounted over the see-through monitor;
- a coin acceptor attached to the cabinet;
- a prize dispenser mounted inside the cabinet, the prize dispenser having a prize storage area extending behind the see-through monitor so that prizes in the prize storage area are visible through the see-through monitor; and
- a computer unit connected to the coin acceptor, the prize dispenser, the see-through monitor and the touch screen overlay, the computer unit being configured to run an interactive video game that displays on the see-through monitor and is controlled by player interactions with the touch screen overlay once a preset game right is collected by the coin acceptor, and to operate the prize dispenser so as to dispense a prize based on an outcome of the video game.

BRIEF DESCRIPTION OF THE DRAWINGS

A detailed description of preferred embodiments will be given herein below with reference to the following drawings.

DETAILED DESCRIPTION OF THE PREFERRED EMBODIMENTS

Figure 1:
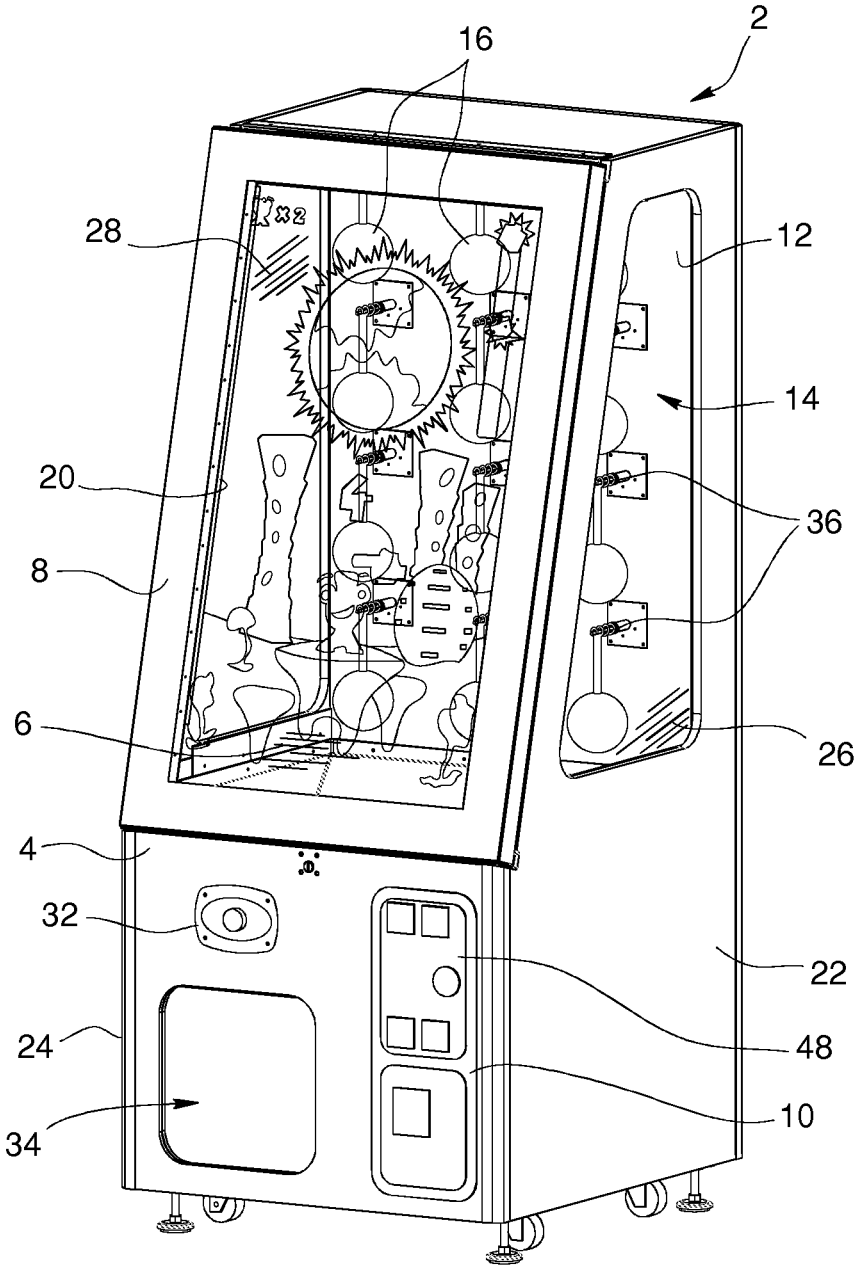
FIG. 1 is a perspective view of a prize merchandiser according to the invention.

Referring to FIG. 1, there is shown a prize merchandiser according to the invention. The prize merchandiser comprises a cabinet 2 having a front wall 4. A see-through monitor 6 extends through the front wall 4. The see-through monitor 6 may be embodied for example by a LCD transparent display model LTI460AP01-101 manufactured by Samsung. Other similar transparent displays may be used if desired. The see-through monitor 6 acts as a window for the cabinet 2 and as a screen to play a game on. The see-through monitor 6 may have the property of becoming more opaque when colors displayed on it are darker. It may be possible to use color patterns to dynamically change the transparency of the see-through monitor 6. A touch screen overlay 8 is mounted over the see-through monitor 6 for user/player interactions. A coin acceptor 10 is attached to the cabinet 2. The coin acceptor 10 may be of a type that accepts tokens or other kinds of substitutes for currency to get credits for playing. A prize dispenser 12 is mounted inside the cabinet 2. The prize dispenser 12 has a prize storage area 14 extending behind the see-through monitor 6 so that prizes 16 preferably but not necessarily of different tiers in the prize storage area 14 are visible through the see-through monitor 6. It should be noted that the prizes 16 have been depicted as balls in the Figures only for simplification purposes and could take any other desired shape appropriate to the configuration of the prize dispenser 12 (e.g. how it works) and the available space in the prize storage area 14.

Figure 4:
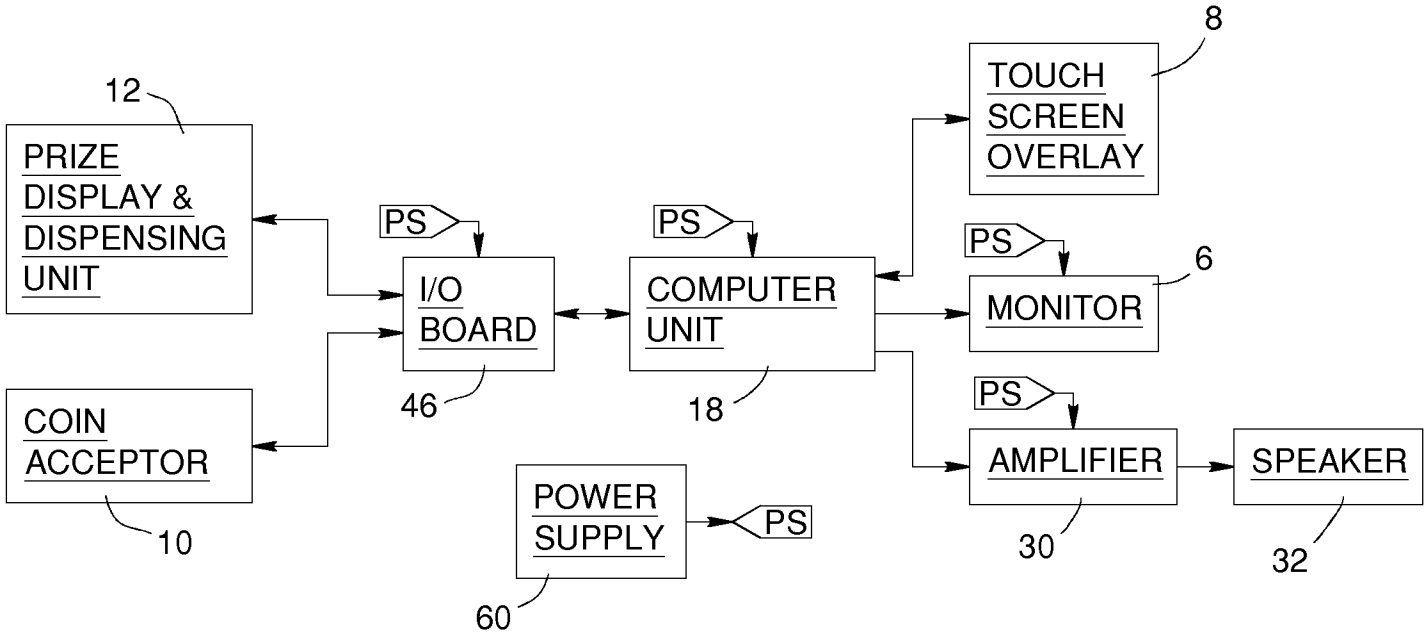
FIG. 4 is a block diagram of a prize merchandiser according to the invention.

Referring to FIG. 4, a computer unit 18 is connected to the coin acceptor 10, the prize dispenser 12, the see-through monitor 6 and the touch screen overlay 8. The computer unit 18 is configured to run an interactive video game that displays on the see-through monitor 6 and is controlled by player interactions with the touch screen overlay 8 once a preset game right is collected by the coin acceptor 10, and to operate the prize dispenser 12 so as to dispense a prize 16 (as shown for example in FIG. 1) based on an outcome of the video game. The computer unit 18 may be connected to the coin acceptor 10 and the prize dispenser 12 through an input/output (I/O) board 46 formed for example of a printed circuit board that allows the computer unit 18 to interact with the coin acceptor 10, the prize dispenser 12, and other possible components of the prize merchandiser. The I/O board 46 may be adapted to be plugged in the computer unit 18.

The prize merchandiser preferably has a sound system for example formed of an amplifier 30 connected to the computer unit 18 and a speaker 32 connected to the amplifier 30 and located on the front wall 4 of the cabinet 2 (as shown for example in FIG. 1). The computer unit 18 is then also configured to generate a sound signal transmitted to the amplifier 30 and outputted by the speaker 32. The speaker 32 may be attached to the cabinet 2 at other locations if desired.

The computer unit 18 may be configured to display a promotional video on the see-through monitor 6 to attract players when nobody plays a game, with the prizes 16 in the prize storage area 14 (as shown for example in FIG. 1) remaining visible through the see-through monitor 6 during both the promotional video and gameplay.

In a possible configuration, a power supply 60 is connected and provides power to the computer unit 18, the see-through monitor 6, the amplifier 30 and the I/O board 46. The power supply 60 may have 5V DC and 12V DC outputs supplying the I/O board 46 which in turn supplies the appropriate power to the coin acceptor 10 and the prize dispenser 12 as needed for their operation. The computer unit 18 may be used to control most if not every electronic aspects of the prize merchandiser and thus form a core component of it. The computer unit 18 may be formed of a computer programmed to operate the components of the prize merchandiser, or a custom device that performs the same.

Figure 2:
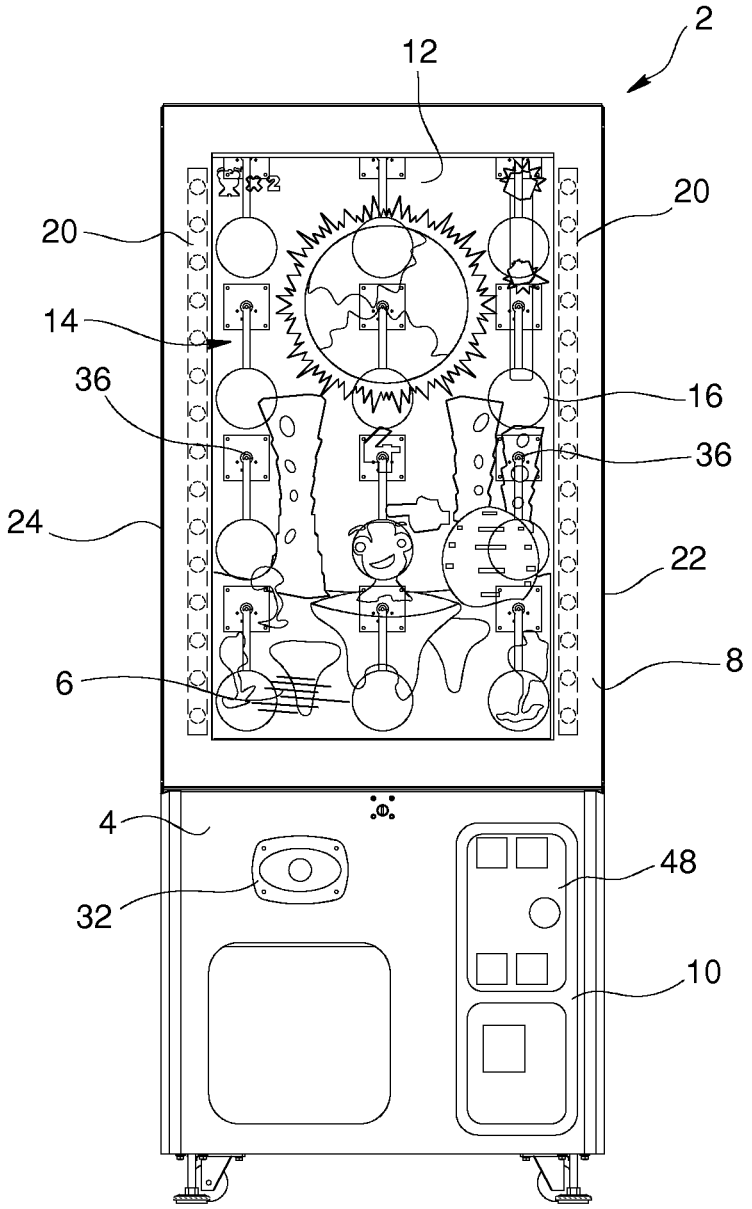
FIG. 2 is a front view of a prize merchandiser according to the invention.

Referring to FIG. 2, a lighting arrangement formed for example of LEDs strips 20 (shown in dashed lines) mounted inside the cabinet 2 and extending on sides of the see-through monitor 6 is preferably provided so that light is projected away from the see-through monitor 6 to illuminate an inner region of the cabinet 2, in particular the prizes 16 in the prize storage area 14. The LEDs strips 20 may be operated to stay on so that the prizes 16 are always well illuminated. They may also be operated to produce some lighting effects, for example color changes by selective operation of LEDs emitting light of different colors, light dimming by changing the number of LEDs switched on or using dimmable LEDs. Other kinds of light bulbs may be used instead of LEDs. Operation of the lighting arrangement may be controlled in an independent manner or by the computer unit 18 (as shown in FIG. 4) if desired.

Referring back to FIG. 1, the cabinet 2 preferably has opposite side walls 22, 24 with respective windows 26, 28 through which the prizes 16 in the prize storage area 14 are visible from outside of the cabinet. The windows 26, 28 preferably have respective films that appear opaque from an inner side of the cabinet 2 and transparent from an outer side of the cabinet 2. Thus, people around the prize merchandiser can see the prizes 16 inside the cabinet 2 while a player does not see outside of the cabinet 2 during game play. The inside lighting produced by the LEDs strips 20 (as shown in FIG. 2) may be put to contribution to enhance that effect. The films may be formed of Scotchcal™ perforated window graphic films model IJ8171 or RG8171 manufactured by the company 3M. Other products having similar properties may be used if desired.

The touch screen overlay 8 may be of a type that has an optical finger input detector, with a frame extending around the see-through monitor 6, and is preferably a multi-touch type. The touch screen overlay 8 may also be of other types if desired, for example a resistive or capacitive type. The touch screen overlay 8 acts as a primary way the player uses to interact with the game.

Figure 3:
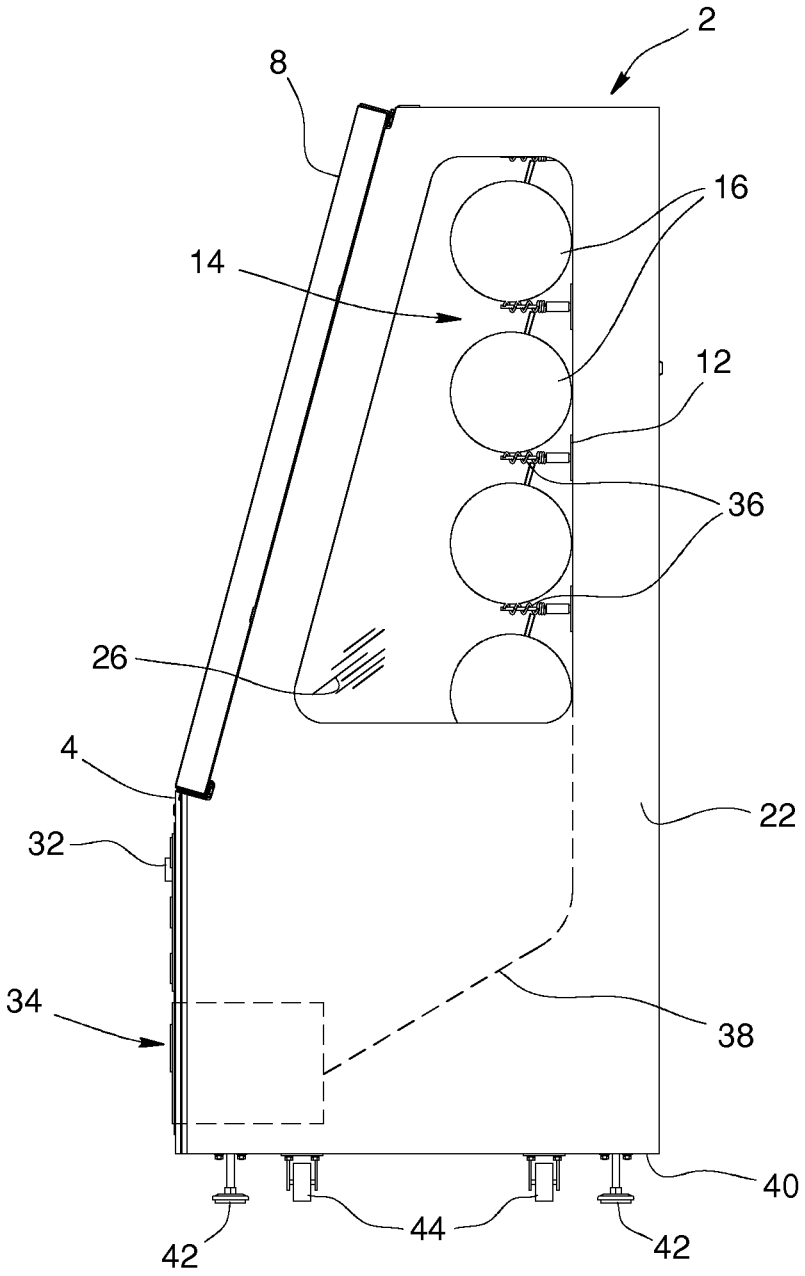
FIG. 3 is a side view of a prize merchandiser according to the invention.

Referring to FIG. 3, the cabinet 2 preferably has a delivery port 34 through which the prize 16 dispensed by the prize dispenser 12 is accessible from outside of the cabinet 2. The delivery port 34 may be provided with a door (not shown) if desired. The prize dispenser 12 may have an arrangement of turning coils 36 projecting in the prize storage area 14 and operable to release a prize 16 hung to one of the turning coils 36 by rotation of the desired turning coil 36, the prize 16 then falling on a chute 38 (shown in dashed lines) extending under the prize storage area 14 down to the delivery port 34. The prize dispenser 12 may have other configurations as found for example in vending machines.

The cabinet 2 may have a bottom wall 40 provided with an arrangement of downwardly projecting adjustable support legs 42 and/or an arrangement of casters 44.

Referring again to FIG. 4, the computer unit 18 may be configured to select one of a small and a big prize 16 to be released by the prize dispenser 12 (as shown for example in FIG. 1) depending on a performance degree of a winning player. The computer unit 18 may be configured to display an operator menu on the see-through monitor 6 in response to a predetermined operator mode triggering action, and adjust merchandiser settings based on operator inputs received on the touch screen overlay 8. The triggering action may come from pressing a button (not shown) hidden behind a coin door 48 (for example shown in FIG. 1) of the coin acceptor 10. The merchandiser settings may comprise a number of credits required for playing the video game, a game difficulty level, a sound volume, and other possible operating parameters of the prize merchandiser if desired.

Figure 5B:
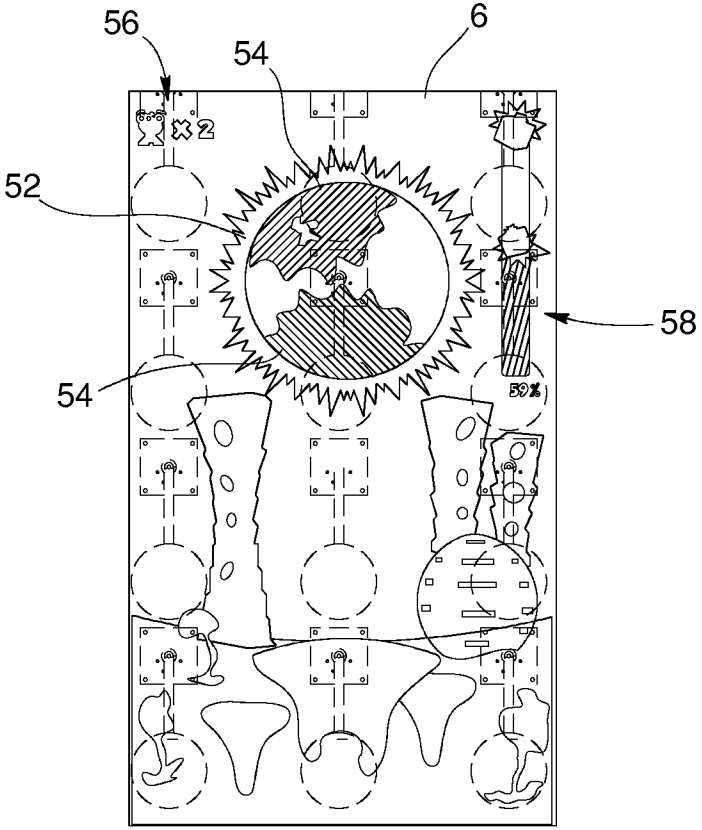
FIGS. 5A and 5B are schematic diagrams illustrating video game screens displayed on a see-through monitor of a prize merchandiser according to the invention.
Figure 5A:
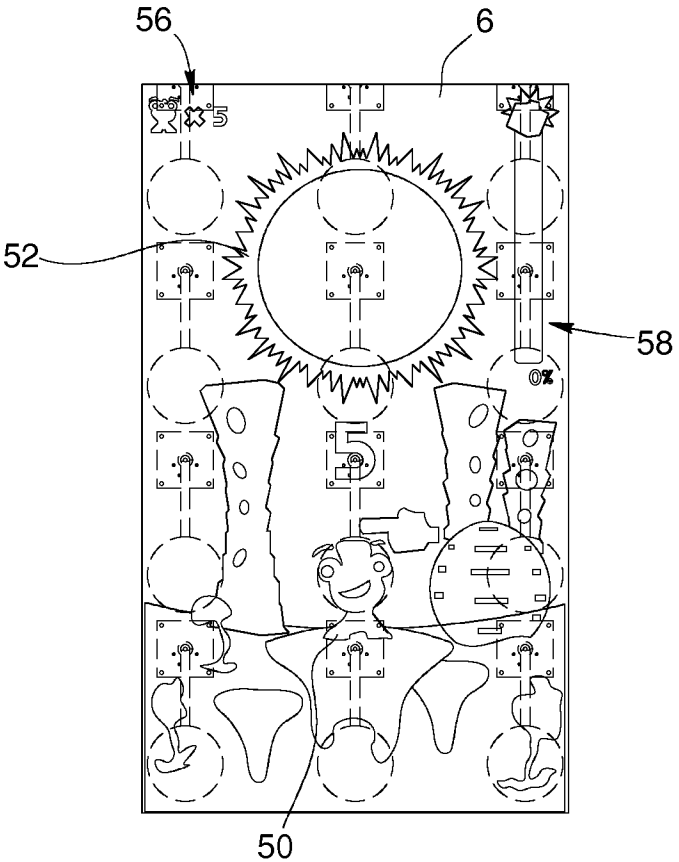

Referring to FIGS. 5A and 5B, various video games may be played on the see-through monitor 6. One proposed video game consists in a skill game in which a player is given a number of creatures (e.g. five creatures as the creature 50) to throw at a target 52 using a flinging motion. When aimed correctly, the creature 50 will hit the target 52 and fill it around the area 54 where it landed as depicted in FIG. 5B. If the player succeeds in completely filling the target 52, he/she has the choice of trying to fill a second target to win a big prize. Otherwise, he/she wins a small prize.

The computer unit 18 (as shown in FIG. 4) may be configured, when running the video game, to manipulate images on the see-through monitor 6 representing the target 52 to be filled, the creature 50 to be thrown at the target 52 using a flinging motion performed on the touch screen overlay 8 (as shown in FIG. 4) to fill an area 54 of the target 52 where the creature 50 has landed, a number of creatures 50 left to fill the target 52 as depicted by pictogram 56, a percentage of the target 52 filled as depicted by pictogram 58, and areas 54 on the target 52 filled.

Figure 6:
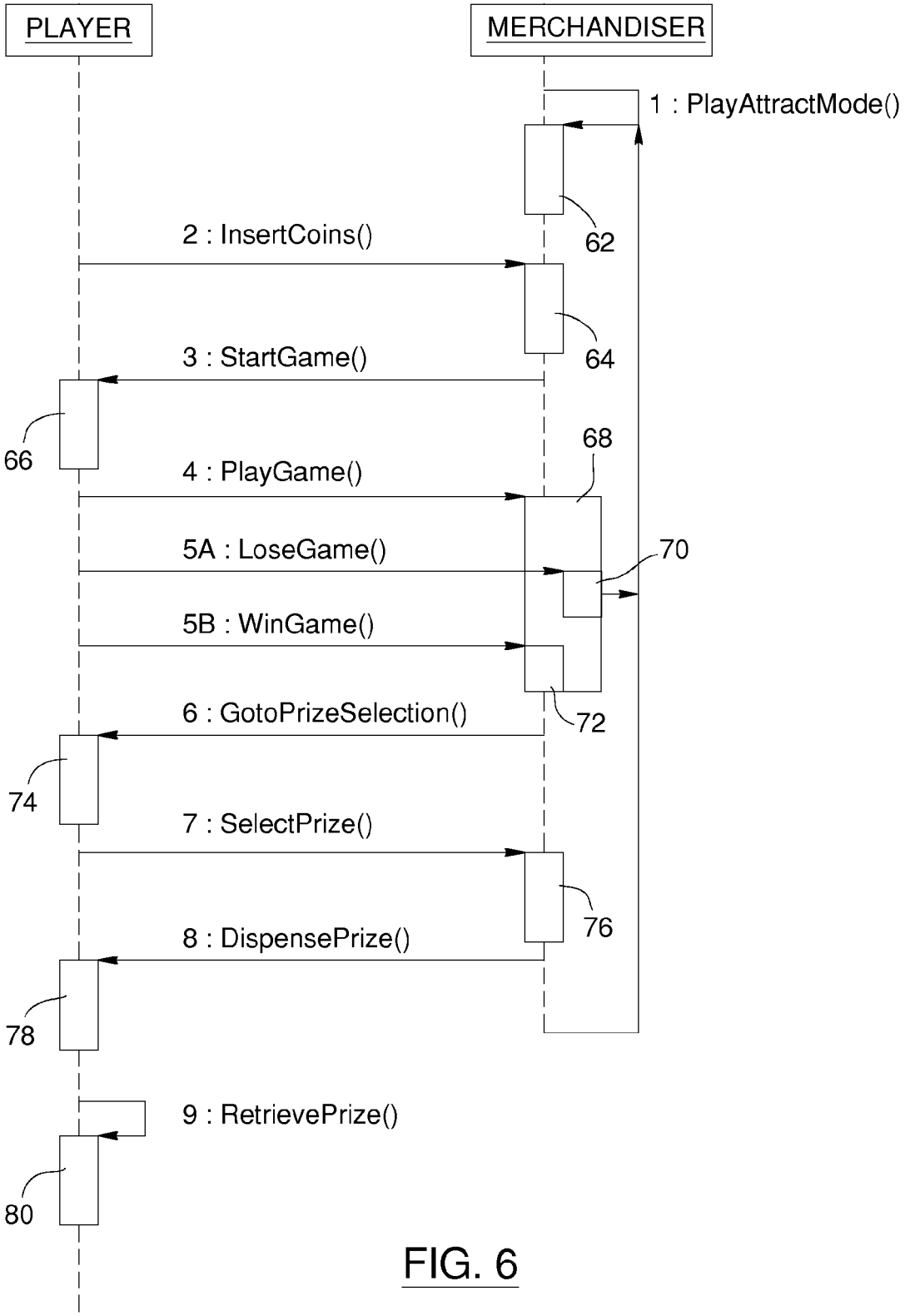
FIGS. 6, 7 and 8 are schematic flow diagrams showing interactions between a player and a prize merchandiser according to the invention.

Referring to FIG. 6, there is shown a game flow diagram depicting possible high level interactions between a player and the prize merchandiser when a game is played. The merchandiser initially enters into a play attract mode as depicted by block 62, during which promotional videos and sounds are for example played on the see-through monitor 6 and the speaker 32. Once the player inserts coins in the coin acceptor 10, the merchandiser passes to an insert coins mode as depicted by block 64, during which a number of credits for playing the game is for example displayed on the see-through monitor 6. Once the number of credits corresponding to the preset game right is reached, the merchandiser passes to a start game mode as depicted by block 66, and then to a play game mode as depicted by block 68, during which the video game is for example displayed on the see-through monitor 6 in response to the player interactions with the touch screen overlay 8. When the game is over, the merchandiser passes to a lose game mode as depicted by block 70 when the player fails to succeed in completely filling the target 52 (or another goal of the game), or to a win game mode as depicted by block 72 if the player succeeds. In lose game mode, the negative outcome is for example reported to the player with a nag screen on the see-through monitor 6 and nag sounds played on the speaker 32, and the merchandiser returns into the play attract mode 62 afterward. In the win game mode, the positive outcome is for example reported to the player with a congratulation screen displayed on the see-through monitor 6 and a winning theme played on the speaker 32 which may also serve to attract new players. The merchandiser then passes to a prize selection mode as depicted by block 74, during which the player is for example presented with a choice of prizes or one is automatically selected by the merchandiser. The merchandiser then passes to a select prize mode as depicted by block 76 followed by a dispense prize mode as depicted by block 78 in which the prize dispenser 12 is operated to dispense the selected prize. As the player collects his/her prize as depicted by block 80, the merchandiser returns into the play attract mode 62.

Figure 7:
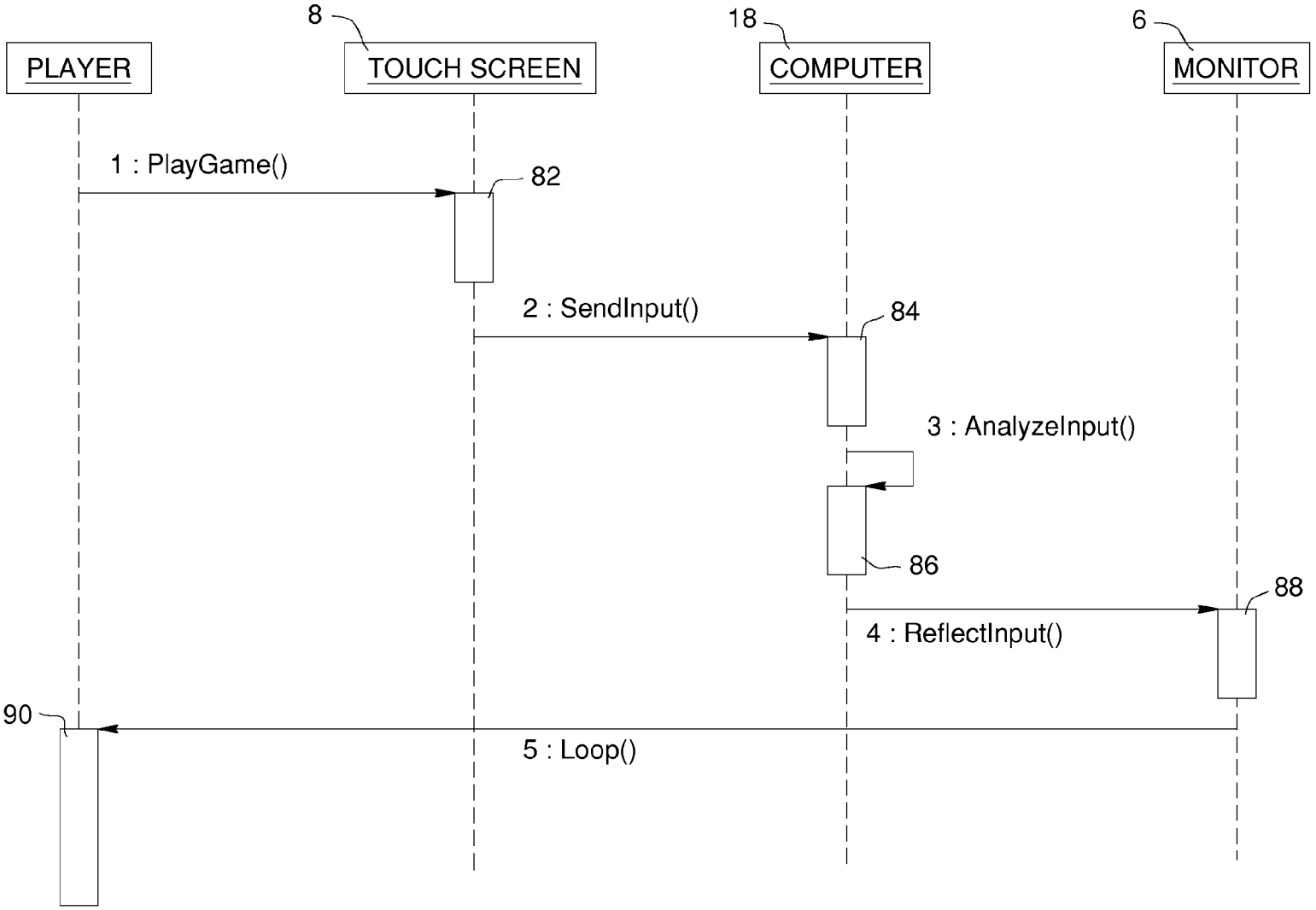

Referring to FIG. 7, there is shown a game flow diagram depicting possible low level interactions between a player and the prize merchandiser when a game is played. The player inputs on the touch screen overlay 8 during game play as depicted by block 82 are transmitted to the computer unit 18 that receives the input as depicted by block 84 and analyzes them as depicted by block 86 in order to reflect the player actions on the monitor corresponding to the inputs as depicted by block 88. The sequence continuously loops back as depicted by block 90 until the game is over.

Figure 8:
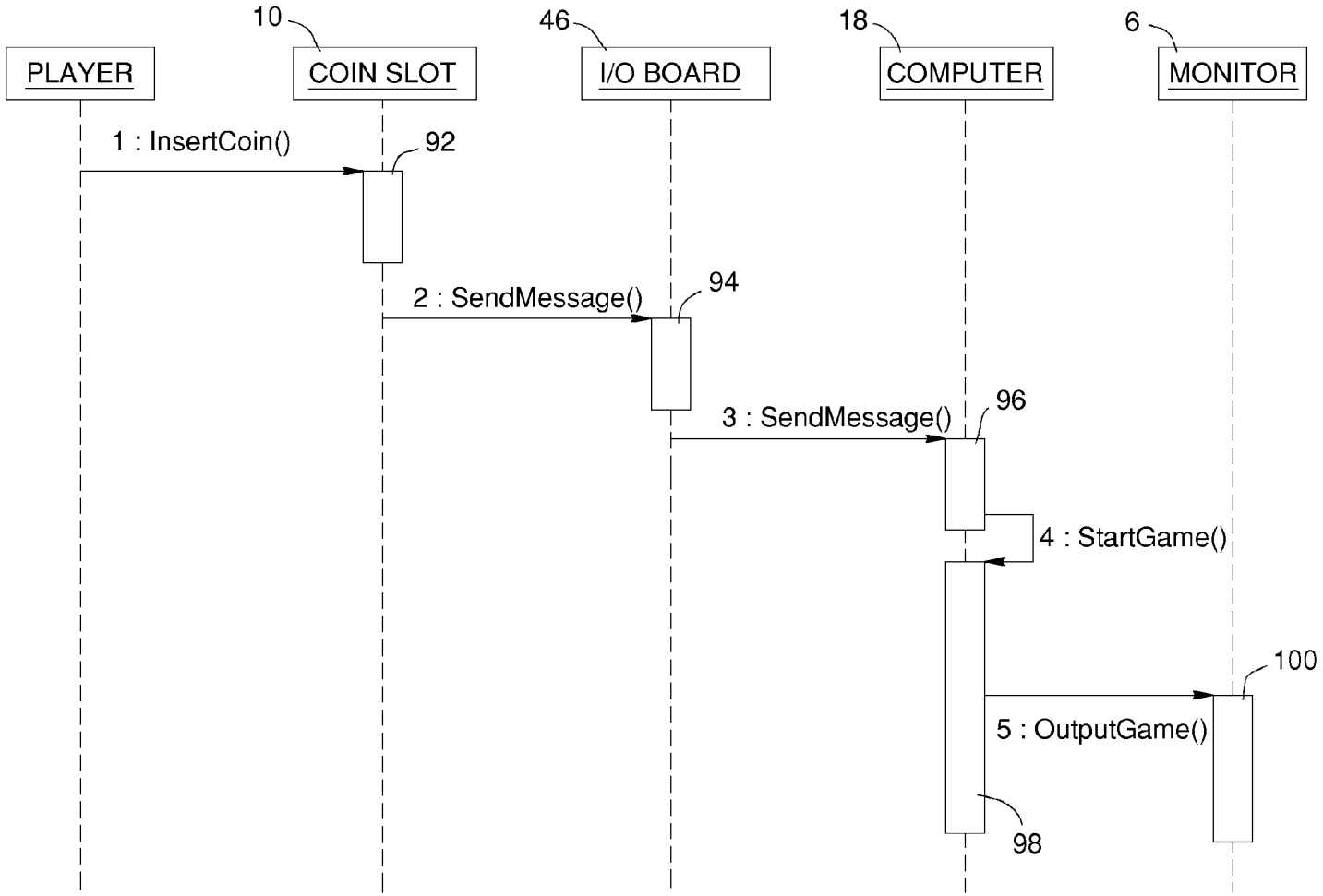

Referring to FIG. 8, there is shown a game flow diagram depicting possible low level interactions between a player and the prize merchandiser when credits are inserted in the coin acceptor 10 and a game is started. The player inserts coins in the coin acceptor 10 as depicted by block 92. The coin acceptor 10 reports the insertion of coins to the I/O board 46 as depicted by block 94 which communicates the information to the computer unit 18 as depicted by block 96. The computer unit 18 enters in start game mode when the number of credits satisfies the preset number of credits for playing a game as depicted by block 98, and displays a game starting screen on the monitor 6 as depicted by block 100.

While embodiments of the invention have been illustrated in the accompanying drawings and described above, it will be evident to those skilled in the art that modifications may be made therein without departing from the invention.

The invention claimed is:

1. A prize merchandiser comprising:

a cabinet having a front wall;

a see-through monitor extending through the front wall;

a touch screen overlay mounted over the see-through monitor;

a coin acceptor attached to the cabinet;

a prize dispenser mounted inside the cabinet, the prize dispenser having a prize storage area extending behind the see-through monitor so that prizes in the prize storage area are visible through the see-through monitor; and a computer unit connected to the coin acceptor, the prize dispenser, the see-through monitor and the touch screen overlay, the computer unit being configured to run an interactive video game that displays on the see-through monitor and is controlled by player interactions with the touch screen overlay once a preset game right is collected by the coin acceptor, and to operate the prize dispenser so as to dispense a prize based on an outcome of the video game.

2. The prize merchandiser according to claim 1, further comprising a lighting arrangement mounted inside the cabinet so that light is projected away from the see-through monitor to illuminate an inner region of the cabinet.

3. The prize merchandiser according to claim 2 wherein the lighting arrangement comprises LEDs strips extending on sides of the see-through monitor.

4. The prize merchandiser according to claim 1, wherein the cabinet has opposite side walls with respective windows through which the prizes in the prize storage area are visible from outside of the cabinet.

5. The prize merchandiser according to claim 4, wherein the windows have respective films that appear opaque from an inner side of the cabinet and transparent from an outer side of the cabinet.

6. The prize merchandiser according to claim 1, further comprising an amplifier connected to the computer unit, and a speaker connected to the amplifier and attached to the cabinet, the computer unit being configured to generate a sound signal transmitted to the amplifier and outputted by the speaker.

7. The prize merchandiser according to claim 1, wherein the computer unit is configured to display a promotional video on the see-through monitor to attract players when nobody plays a game, the prizes in the prize storage area remaining visible through the see-through monitor during both the promotional video and gameplay.

8. The prize merchandiser according to claim 1, wherein the touch screen overlay has an optical finger input detector.

9. The prize merchandiser according to claim 1, wherein the cabinet has a delivery port through which the prize dispensed by the prize dispenser is accessible from outside of the cabinet.

10. The prize merchandiser according to claim 9, wherein the prize dispenser has an arrangement of turning coils projecting in the prize storage area and operable to release a prize hung to one of the turning coils by rotation of said one of the turning coils, and a chute extending under the prize storage area down to the delivery port.

11. The prize merchandiser according to claim 1, wherein the cabinet has a bottom wall provided with at least one of an arrangement of downwardly projecting adjustable support legs, and an arrangement of casters.

12. The prize merchandiser according to claim 1, wherein the computer unit is connected to the coin acceptor and the prize dispenser through an input/output board.

13. The prize merchandiser according to claim 1, wherein the computer unit is configured to select one of a small and a big prize to be released by the prize dispenser depending on a performance degree of a winning player.

14. The prize merchandiser according to claim 1, wherein the computer unit is configured to display an operator menu on the see-through monitor in response to a predetermined operator mode triggering action, and adjust merchandiser settings based on operator inputs received on the touch screen overlay.

15. The prize merchandiser according to claim 14, wherein the merchandiser settings comprise at least one of a number of credits required for playing the video game, a game difficulty level and a sound volume.

16. The prize merchandiser according to claim 1, wherein the computer unit is configured, when running the video game, to manipulate images on the see-through monitor representing a target to be filled, a creature to be thrown at the target using a flinging motion performed on the touch screen overlay to fill an area of the target where the creature has landed, a number of creatures left to fill the target, a percentage of the target filled, and areas on the target filled.

* * * * *